US006835104B2

(12) United States Patent
West et al.

(10) Patent No.: US 6,835,104 B2
(45) Date of Patent: Dec. 28, 2004

(54) FIELD CONVERTIBLE TAP-OFF UNIT

(75) Inventors: Rodney J. West, Liberty, IN (US); Glenn S. O'Nan, Oxford, OH (US)

(73) Assignee: Square D Company, Palatine, IL (US)

( * ) Notice: Subject to any disclaimer, the term of this patent is extended or adjusted under 35 U.S.C. 154(b) by 0 days.

(21) Appl. No.: 10/172,727

(22) Filed: Jun. 14, 2002

(65) Prior Publication Data

US 2003/0232532 A1 Dec. 18, 2003

(51) Int. Cl.[7] ..... H01R 9/22
(52) U.S. Cl. ..... 439/709
(58) Field of Search ..... 439/709, 711, 439/712, 715, 719, 721, 723, 724

(56) References Cited

U.S. PATENT DOCUMENTS 3,728,656 A * 4/1973 Neuber ..... 336/147
3,775,733 A * 11/1973 Ege ..... 439/724
4,345,806 A * 8/1982 McHenney ..... 439/510
4,353,610 A * 10/1982 Deters ..... 439/510
4,784,614 A * 11/1988 Sadigh-Behzadi ..... 439/488
5,007,888 A * 4/1991 Goutiere ..... 439/189
5,063,314 A * 11/1991 DeSantis ..... 310/71
5,064,384 A * 11/1991 Weaver ..... 439/511
5,556,301 A * 9/1996 Chishima et al. ..... 439/507
5,994,989 A * 11/1999 Rowe et al. ..... 335/202
6,095,850 A * 8/2000 Liu ..... 439/488
6,129,578 A * 10/2000 McCarrick et al. ..... 439/488
6,129,595 A * 10/2000 Scanlon et al. ..... 439/716

* cited by examiner

*Primary Examiner*—Javaid H. Nasri

(57) ABSTRACT

A field convertible tap-off base for an electrical busway distribution fitting. The field convertible tap-off base includes an AC phase termination side and a field configurable side having first and second configurable electrical terminals. The AC phase termination side provides terminals for connecting three AC phase conductors of a busway electrical distribution system to any one of a number of load bases configured for electrical components such as circuit breakers, switches, fuses, lugs or other special functions. The first and second configurable terminals permit two additional busway electrical conductors to be used for neutral, high current capacity neutral, secondary ground, DC current or other special functions which might be defined in the busway electrical distribution system.

9 Claims, 3 Drawing Sheets

FIELD CONVERTIBLE TAP-OFF UNIT

CROSS-REFERNCE TO RELATED PATENTS

Not applicable

STATEMENT REGARDING FEDERALLY SPONSORED RESAEARCH OR DEVELOPMENT

Not applicable

FIELD OF THE INVENTION

The present invention relates to the field of electrical distribution, and particularly to a busway tap-off unit having electrical phase terminals and field convertible additional terminals.

BRIEF DESCRIPTION OF THE DRAWINGS

The features of the invention will become more clearly understood from the following detailed description of the invention read together with the drawings in which.

Figure 1:
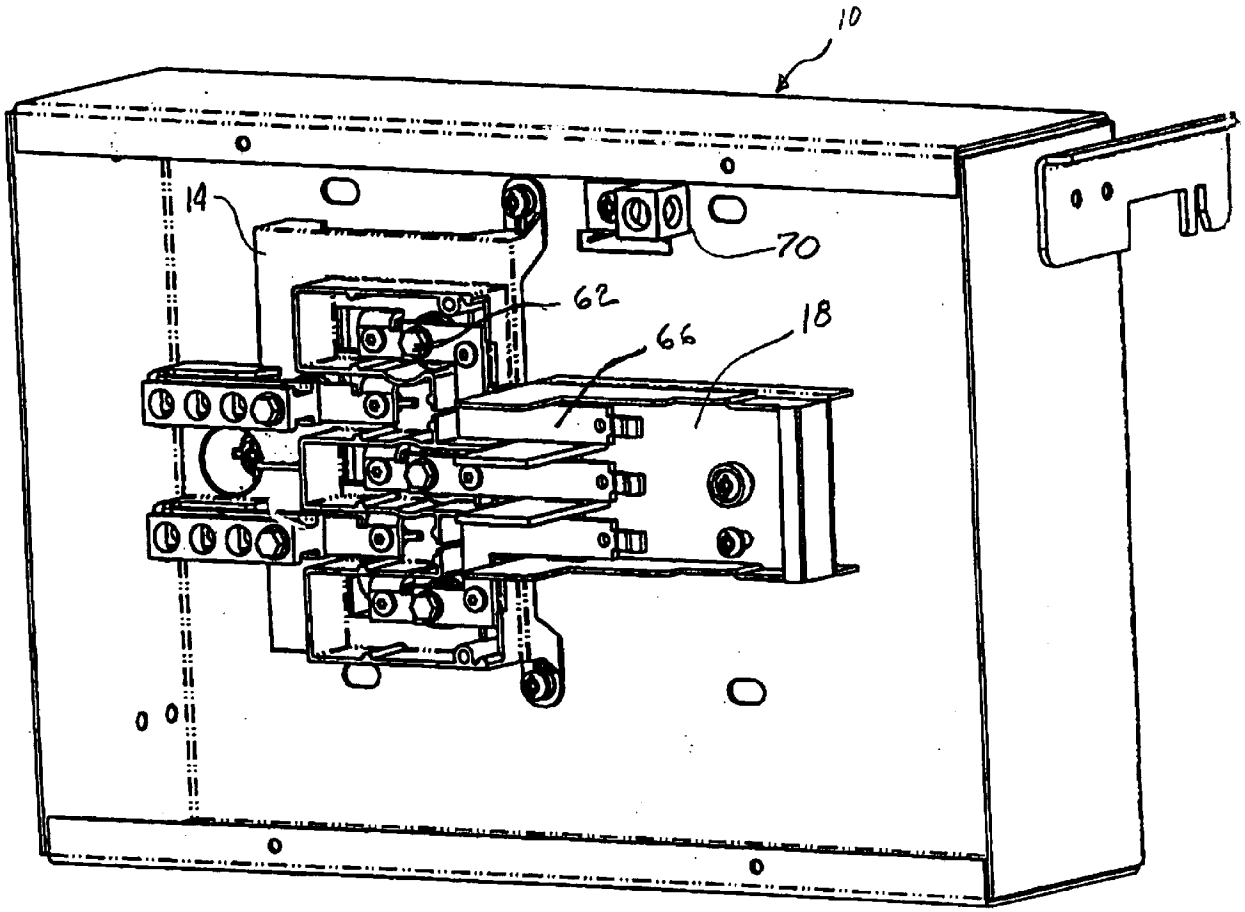
FIG. 1 illustrates a busway tap-off unit with a plug-in base manufactured in accordance with the present invention.

Before one embodiment of the invention is explained in detail, it is to be understood that the invention is not limited in its application to the details of construction described herein or as illustrated in the drawings. The invention is capable of other embodiments and of being practiced or being carried out in various other ways. Further, it is to be understood that the phraseology and terminology used herein is for the purpose of description and should not be regarded as limiting.

DETAILED DESCRIPTION OF THE DRAWINGS

FIG. 1 illustrates the interior of a field convertible tap-off unit 10 with a plug-in base assembly 14, manufactured in accordance with the present invention. Also shown is a load base 18, manufactured in accordance with the present invention. The load base 18 shown in FIG. 1 is for a circuit breaker, however, it can be easily replaced with load bases for other load control devices such as a switch load base, a fuse load base, a lug terminal load base or other specialized load base as required by the end user. A typical busway electrical distribution system is provided with a number of electrically insulated electrical conductors enclosed within a housing. The tap-off unit 10 provides a means for accessing the enclosed electrical conductors such that electrical equipment can be connected to the busway power system. A typical power system might include three AC phase conductors and an equipment ground provided by the busway housing. In other applications a neutral conductor or a secondary (isolated) ground conductor or both might be required. Some power systems require a neutral with higher current carrying capacity. In still other systems a DC power source might be required in addition to the three phase AC power. The plug-in base assembly 14 of the present invention permits the installer to configure one tap-off unit 10 for use with any of the power systems described above or some other specialized power system requirement when the busway electrical distribution system being connected to includes conductors for that application.

Figure 2:
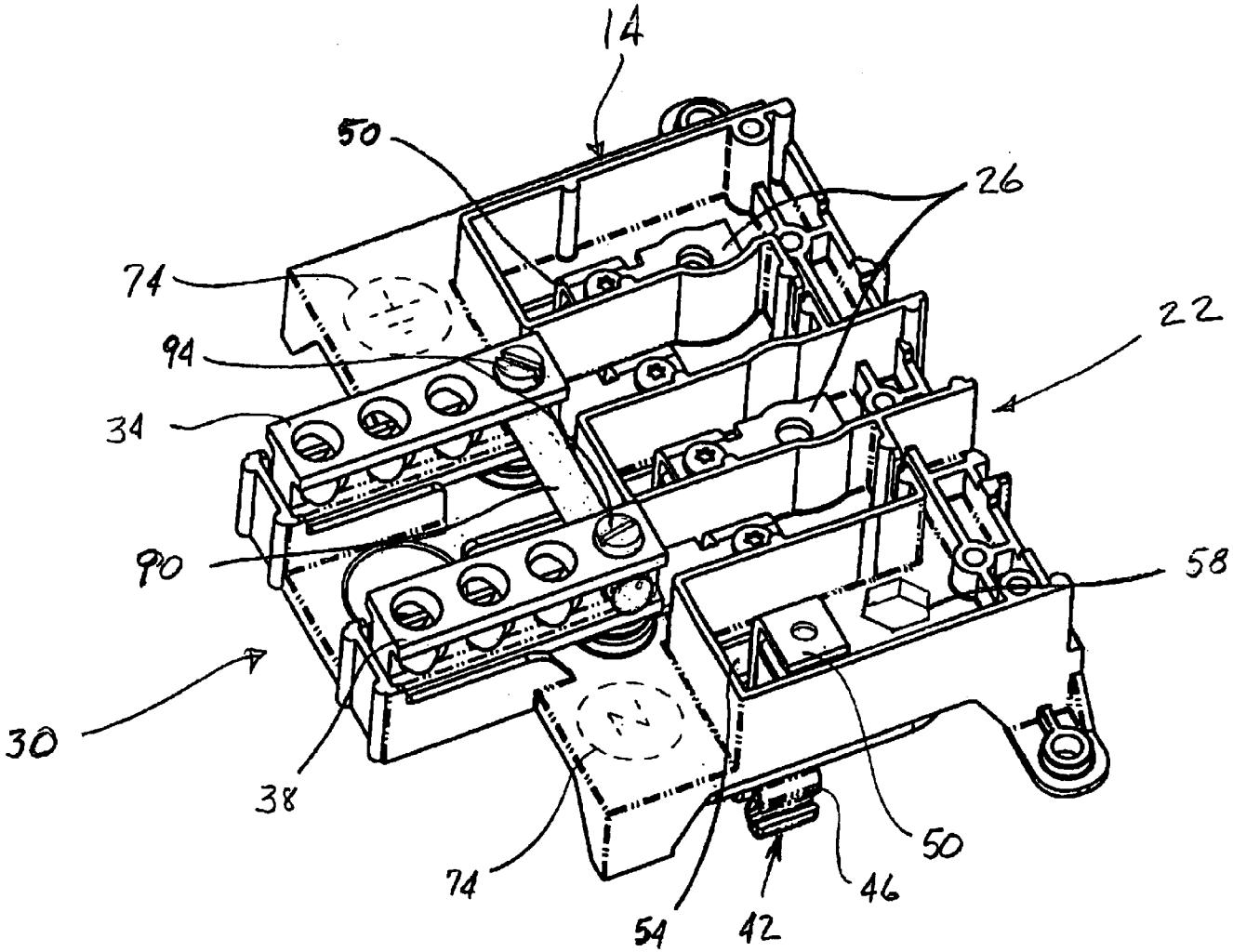
FIG. 2 is an isometric top view of the plug-in base of FIG. 1.

FIG. 2 illustrates the top of the convertible plug-in base assembly 14 of the present invention. The plug-in base 14, made from an electrically insulating material, includes an AC phase termination side 22, where three load base terminals 26 (only two shown) are provided for connecting to any of the various load bases 18, and a configurable side 30 where a first configurable conductor terminal 34 and a second configurable conductor terminal 38 are provided such that the installer can configure the tap-off unit 10 to the power system on which it is being installed. The plug-in base 14 provides support and electrical separation for the terminals 26, 34 and 38. Each terminal 26, 34 and 38 is electrically connected to one of the electrical conductors in the busway electrical distribution system by a plug-in jaw assembly 42. Each plug-in jaw assembly 42 includes a jaw 46, which engages the electrical conductor and a stab 50, which passes through an opening 54 in the plug-in base 14. The stab 50 is electrically connected to the load base terminal 26. A shaped recess 58 is integrally formed in the plug-in base 14 at each of the three load base terminals 26. The stab 50 and load base terminal 26 can be configured as one part, thereby eliminating one electrical connection. The shape of the recess 58 coincides with that of a bolt head or nut 62 used in making the electrical connection between the load base terminal 26 and the load base bus 66 (FIG. 1) such that the bolt head or nut 62 can be received therein and prevented from rotating. As an alternate construction, the bolts or nuts 62 can be an insert molded into the plug-in base 14, thereby making connections easier and eliminating loose parts which could be easily lost.

Figure 3:
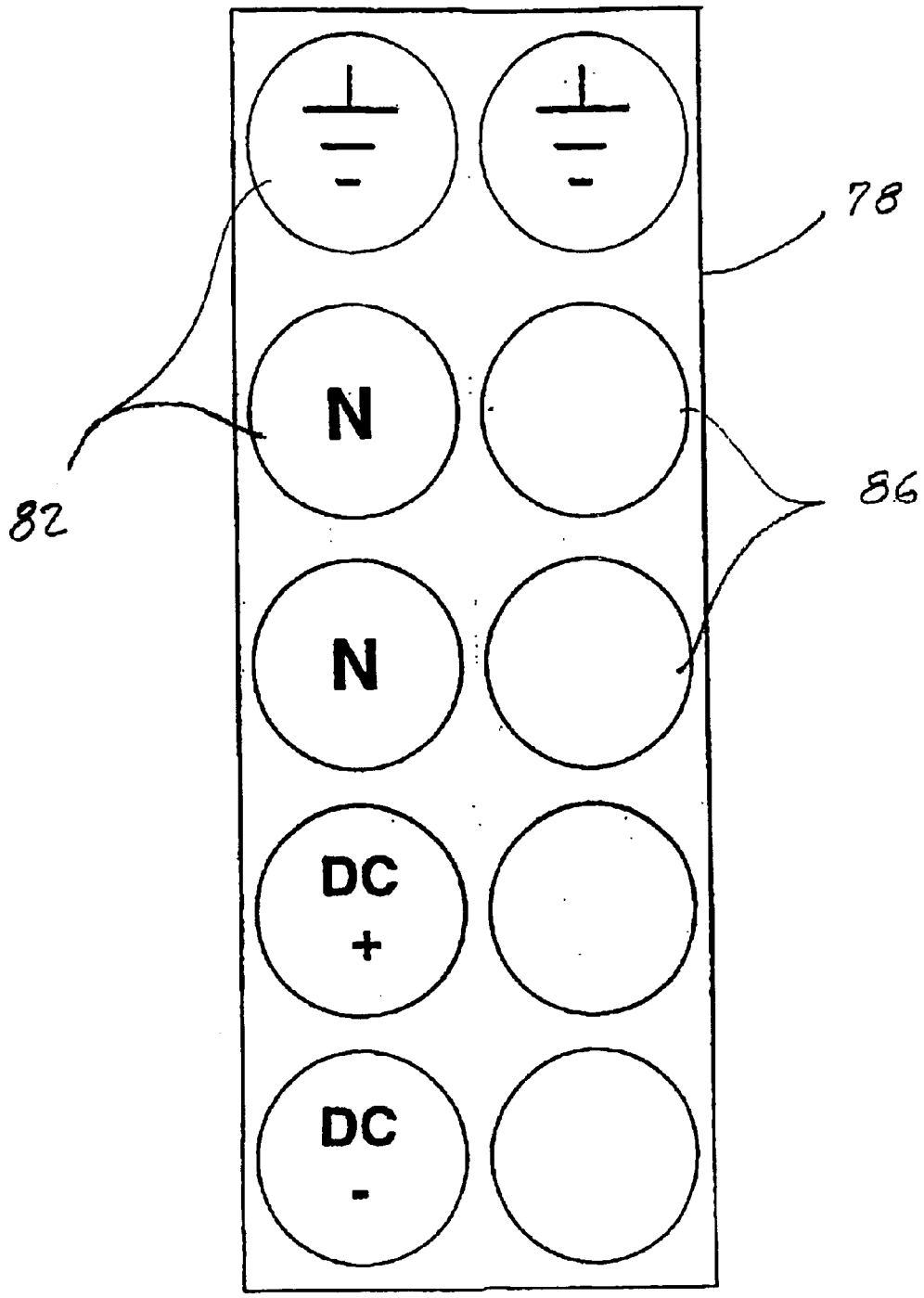
FIG. 3 illustrates a selection of labels for use with the convertible tap-off unit.

Configuration of the tap-off unit 10 is accomplished by first determining if electrical conductors other than the three AC phase conductors are present in the busway device on which the tap-off unit 10 will be installed. If no additional electrical conductors are present in the busway device, an equipment ground conductor can be connected to the equipment ground lug 70 (FIG. 1) which is attached to the enclosure of the tap-off unit 10 and provided with an electrical connection with the busway housing. If additional electrical conductors are present in the busway device, the electrical function of each must be determined. A label 74 indicating that electrical function can then be placed adjacent to one or both of the first and second configurable terminals, 34 and 38, respectively. A label sheet 78, as shown in FIG. 3, including labels for the most commonly expected electrical functions 82 and blank labels 86 for special functions can be provided with the tap-off unit 10. If both first and second configurable terminals, 34 and 38, respectively, have the same electrical function, a jumper 90 connecting the terminals 34 and 38 can be installed. The jumper 90 is electrically connected to both terminals 34 and 38 by binding screws 94. The final step in configuring the tap-off unit 10 is selecting and installing the desired load base 18, if it has not been provided with the tap-off unit 10.

We claim:

1. A field configurable base for a busway tap-off unit adapted for use with a busway electrical distribution system having a plurality of electrical phase conductors and at least one additional electrical conductor for a preselected function, said configurable base comprising:

a plug-in base defining a phase termination side and a field configurable side provided with a first configurable terminal and a second configurable terminal, an electrical function of each of said first and said second configurable terminals is determined by the electrical function of the additional electrical. conductors to which they are connected.

2. The field configurable base of claim 1, wherein said plug-in base is made from an electrically insulating material.

3. The field configurable base of claim 1, wherein said phase termination side is provided with a plurality of electrical terminals for connecting to an appropriate load base for a user selected load control device.

4. The field configurable base of claim 1, wherein appropriate symbol labels indicating the electrical function of said first and second configurable terminals can be placed on said plug-in base adjacent said first and second configurable terminals.

5. The field configurable base of claim 1, wherein said first and second configurable terminals can be electrically connected together when the electrical function of their associated additional electrical conductors is the same.

6. A field configurable base for a busway tap-off unit comprising:

a plug-in base defining a phase termination side for connecting to an appropriate load base for a user selected load control device and a functionally independent field configurable side having a first configurable terminal and a second configurable terminal, an electrical function of each of said first and said second configurable terminals being determined by the electrical function of an electrical conductor in a busway electrical distribution system to which each is connected.

7. A method of configuring a busway tap-off unit to an electrical busway power distribution system having both electrical phase conductors and additional function electrical conductors comprising the steps of:

determining the electrical function of each electrical conductor in the electrical busway power distribution system other than the phase conductors;

selecting an appropriate symbol label for identifying the electrical function of said additional function electrical conductor to be connected to a first configurable terminal and fixing it to the plug-in base adjacent the first configurable terminal;

selecting an appropriate symbol label for identifying the electrical function of one of said additional function electrical conductors to be connected to a second configurable terminal and fixing it to the plug-in base adjacent the second configurable terminal;

electrically connecting the first and second configurable terminals together if the electrical function of their associated electrical conductors is the same.

8. A method of configuring a busway tap-off unit to an electrical busway power distribution system having both electrical phase conductors and additional function electrical conductors comprising the steps of:

selecting a load control device and associated load base;

connecting the load terminals to the load bussing of the load base;

determining the electrical function of each electrical conductor in the electrical busway power distribution system other than the electrical phase conductors;

selecting an appropriate symbol label for identifying the electrical function of the additional function electrical conductor to be connected to a first configurable terminal and fixing it to the plug-in base adjacent the first configurable terminal;

selecting an appropriate symbol label for identifying the electrical function of the additional function electrical conductor to be connected to a second configurable terminal and fixing it to the plug-in base adjacent the second configurable terminal;

electrically connecting the first and second configurable terminals together if the electrical function of their associated electrical conductors is the same.

9. The field configurable base of claim 6, wherein said first and second configurable terminals can be electrically connected together by a jumper when the electrical function of their associated electrical conductors is the same.

* * * * *